US007607733B1

(12) United States Patent
Lin et al.

(10) Patent No.: US 7,607,733 B1
(45) Date of Patent: Oct. 27, 2009

(54) FOLDING SUPER CHAIR

(76) Inventors: Mei Chuen Lin, 9F, No. 275-1, Yuan-Hua Road, Chung-Li City, Taoyuan Hsien (TW); Tzu Mei Wang, 9F, No. 275-1, Yuan-Hua Road, Chung-Li City, Taoyuan Hsien (TW)

( * ) Notice: Subject to any disclaimer, the term of this patent is extended or adjusted under 35 U.S.C. 154(b) by 0 days.

(21) Appl. No.: 12/178,774

(22) Filed: Jul. 24, 2008

(51) Int. Cl.
*A47C 15/00* (2006.01)

(52) U.S. Cl. ..... 297/248; 297/440.2

(58) Field of Classification Search ..... 297/248, 297/440.2

See application file for complete search history.

(56) References Cited

U.S. PATENT DOCUMENTS 3,009,738 A * 11/1961 Herbert ..... 297/248
3,127,218 A * 3/1964 Banke ..... 297/248
3,614,157 A * 10/1971 Hendrickson et al. ... 297/248 X
6,478,375 B2 * 11/2002 Richardson ..... 297/248
7,111,902 B1 * 9/2006 Conner ..... 297/248

* cited by examiner

*Primary Examiner*—Anthony D Barfield
(74) *Attorney, Agent, or Firm*—Rabin & Berdo, P.C.

(57) ABSTRACT

A folding super chair includes a front leg frame, a backrest, a backrest frame and a ganging device. The backrest frame has a contour corresponding to an upper inner portion of the front leg frame and an L-shaped cross section. The backrest frame is disposed between the front leg frame and the backrest. The backrest is placed on the backrest frame, which relieve stress. Thus, a ridge of the backrest does not deform, and the backrest is securely fixed on the folding super chair. The ganging device includes a main member, a slot fastener and a knob fastener. The main member has a front face, a rear face and two side faces. The rear face is larger than the front face, and therefore the two side faces form an included angle therebetween. When the folding super chairs are lined up and connected by the ganging device, the folding super chairs form a curved row.

6 Claims, 13 Drawing Sheets

FOLDING SUPER CHAIR

BACKGROUND OF THE INVENTION

1. Field of the Invention

The present invention relates generally to a folding chair, and more particularly to a folding super chair having a reinforced structure to mount a backrest and a ganging device that allows a plurality of the chairs to be connected in a curved row.

2. The Prior Arts

Referring to FIG. 12, a conventional folding chair includes a backrest A and a front leg frame B. The backrest A includes an integrally formed metal plate and a cushion. A contour of the backrest A is corresponding to that of an upper inner portion of the front leg frame. A connection ridge A1 is extended from an upper edge of the backrest A. The upper portion of the front leg frame B is provided with a plurality of screw holes and the connection ridge A1 is provided with a plurality of screw holes corresponding to the screw holes of the front leg frame B. The connection ridge A1 is pressed against the upper inner portion of the front leg frame B. Then, screws C are driven through the screw holes of the front leg frame B and the connection ridge A1 to connect the front leg frame B with the backrest A. All stress are concentrated on the screws C and their surrounding. However, the connection ridge A1 is only a thin metal strip. After a long time in use, the stress caused by the screws C is likely to deform the connection ridge A1 or enlarge screw holes. Thus, the backrest A gets loose and even breaks away from the front leg frame B.

The folding chairs are arranged in rows for indoor and outdoor events such as conference, meeting, and ball games. In order to provide an orderly seating, the folding chairs are neatly lined up and then interconnected with ganging devices. Referring to FIG. 13, a conventional ganging device for a folding chair include a metal L-bar D and a metal loop E respectively disposed at both sides of the folding chair. The L-bar D is fitted into the loop E on another chair, thereby connecting two chairs together. Taking advantage of the L-bar D and the loop E, the folding chairs are neatly lined up and connected side by side. The disadvantage of the conventional ganging devices is that the gap between the connected chairs is small. When people, especially overweight or heavily built people, sit down, they are too close to each other. When trying to enlarge the gaps to offer more spacious seating for greater comfort, the chairs are lined up one by one and are not connected with the ganging devices. However, it is hard to keep the folding chairs in a row neatly without the ganging devices. Another disadvantage of the conventional ganging devices is that a row of the folding chairs connected by the ganging devices is a straight line. In a large event, the row of the chairs is very long. People sitting at both ends need to turn their heads to watch a central stage. It causes a strain on the neck.

SUMMARY OF THE INVENTION

A primary objective of the present invention is to provide a folding super chair, which overcome the disadvantage of the conventional design that the backrest can not securely connect with the front leg frame.

Another objective of the present invention is to provide a folding super chair having a ganging device. The ganging device connects the chairs and allows the chairs to be arranged in a curved row, which provides people sitting at both sides of row a good view to the front center.

In order to achieve the objectives mentioned above, a folding super chair according to the present invention provides a backrest frame, which may be made of metal. The backrest frame has an L-shaped cross section and a dome shaped contour corresponding to that of an upper inner portion of a front leg frame. The backrest frame is spot welded onto the upper inner portion of the front leg frame. Because the backrest frame has the L-shaped cross section, the backrest frame and the front leg frame provide a space to accommodate a backrest. The backrest is placed in the backrest frame. The front leg frame, the backrest frame and the backrest are provided with a plurality of fixing holes. Screws are driven through the fixing holes and connect the front leg frame, the backrest frame and the backrest together. The backrest frame according to the present invention provides an L-shaped strip to allow the backrest to rest thereon, which redistributes part of stress from screws to the backrest frame. The screwing stress is relieved. Thus, the upper edge of the backrest is less likely to deform than the conventional design. The screw holes are less likely to be enlarged. The backrest can be securely fixed on the front leg frame.

In order to achieve the second objectives, a folding super chair according to the present invention provides a ganging device. The ganging device is provided with a frame-like main member. The main member includes a front face, a rear face and two side faces. The rear face is larger than the front face. Thus, the front face and the rear face are not perpendicular to the side faces. Each of the side face is slanted from the rear face to the front face. There is an included angle between the side faces. One of the side faces connects with a first chair and the other side face connects with a second chair. The ganging device connects the chairs together and keeps a distance between the chairs. Moreover, the side faces of the ganging device have the included angle therebetween. The folding super chairs equipped with the ganging devices according to the present invention can form a curved row, which is especially useful in a large event. People sitting at both sides of row can enjoy a central front view.

The backrest frame according to the present invention allows the backrest to rest thereon, thereby redistributing the stress caused by the screws. Therefore, it prevents the backrest from getting loose.

The ganging device according to the present invention installed between two chairs can keeps a gap between chairs, which provides comfortable seating for user. The side faces of the ganging device have an included angle therebetween. When a plurality of the folding super chairs is connected by the ganging device, the folding super chairs form a curved row, thereby providing a good view to the front for the users.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
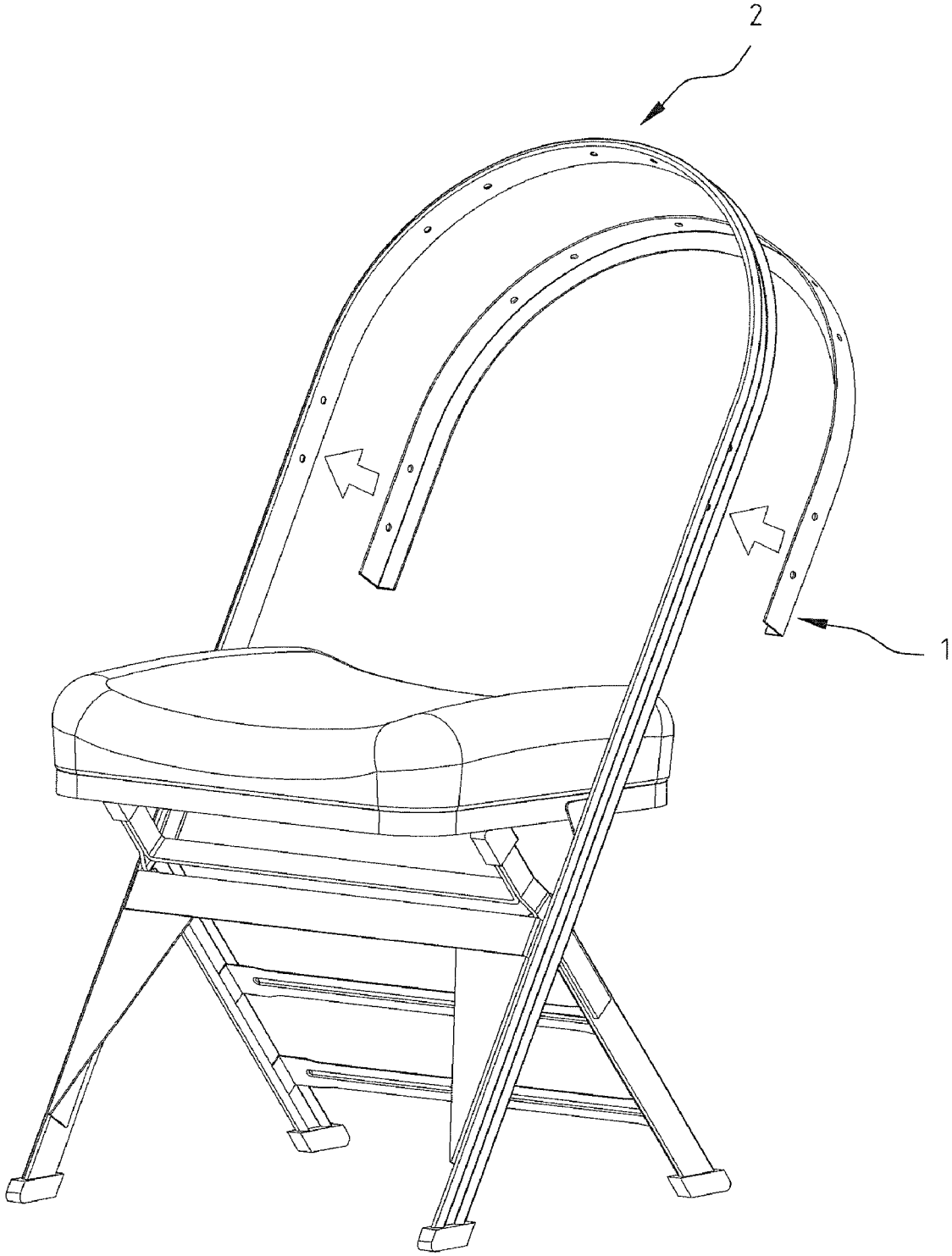
FIGS. 1-5 are perspective views showing assembly process of a folding super chair according to the present invention.
Figure 2:
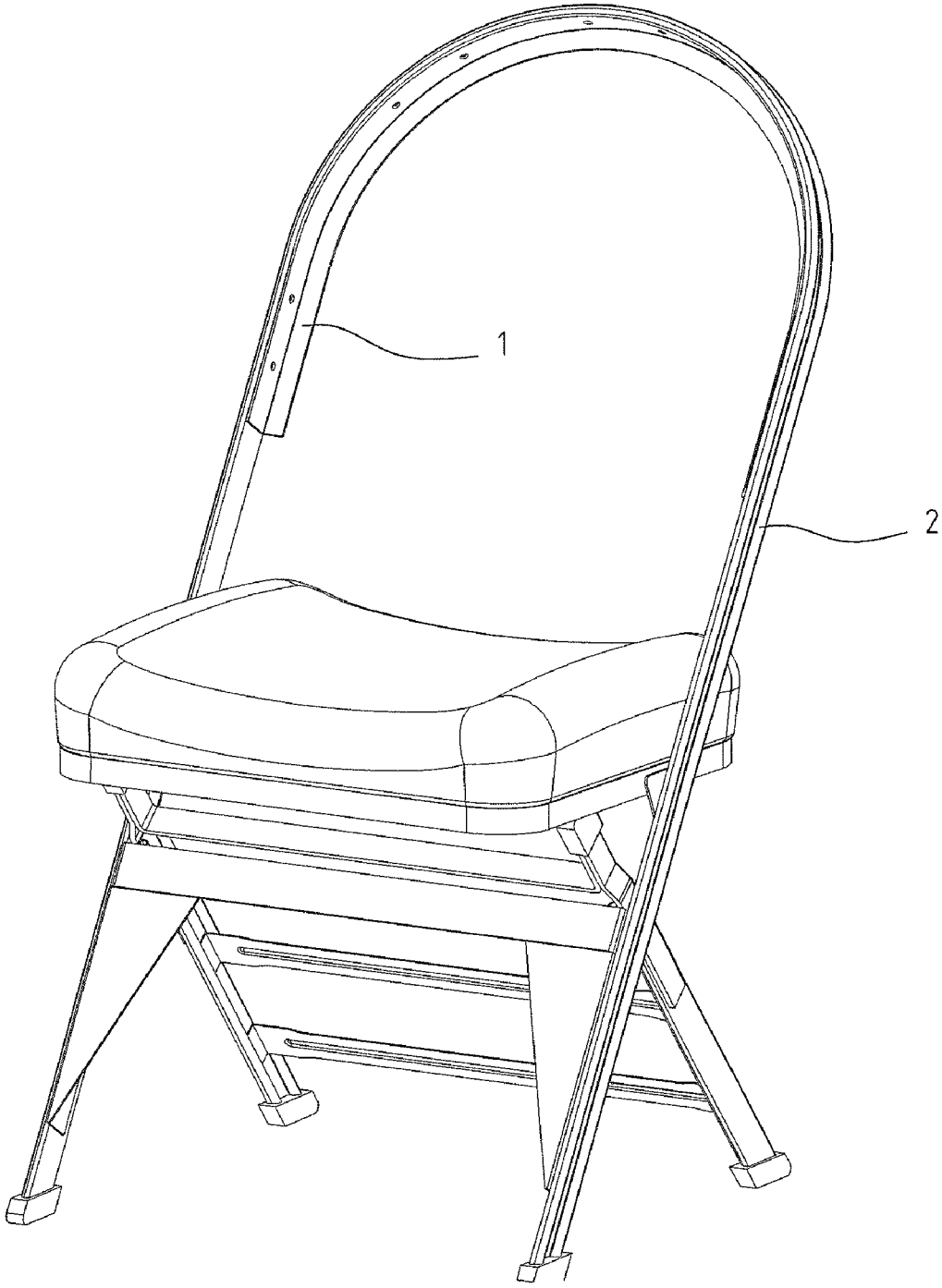

Referring to FIG. 1, a folding super chair according to the present invention includes a front leg frame 2, a rear leg frame, a footrest, a seat, and a backrest frame 1. A contour of the backrest frame 1 is corresponding to that of an upper inner portion of the front leg frame 2. A cross section of the backrest frame 1 is L-shaped. Referring to FIG. 2, a side of the backrest frame 1 is pressed against and spot-welded to the upper inner portion of the front leg frame 2. The other side of the backrest frame 1 is perpendicular to the front leg frame 2 as shown in FIG. 2.

Figure 3:
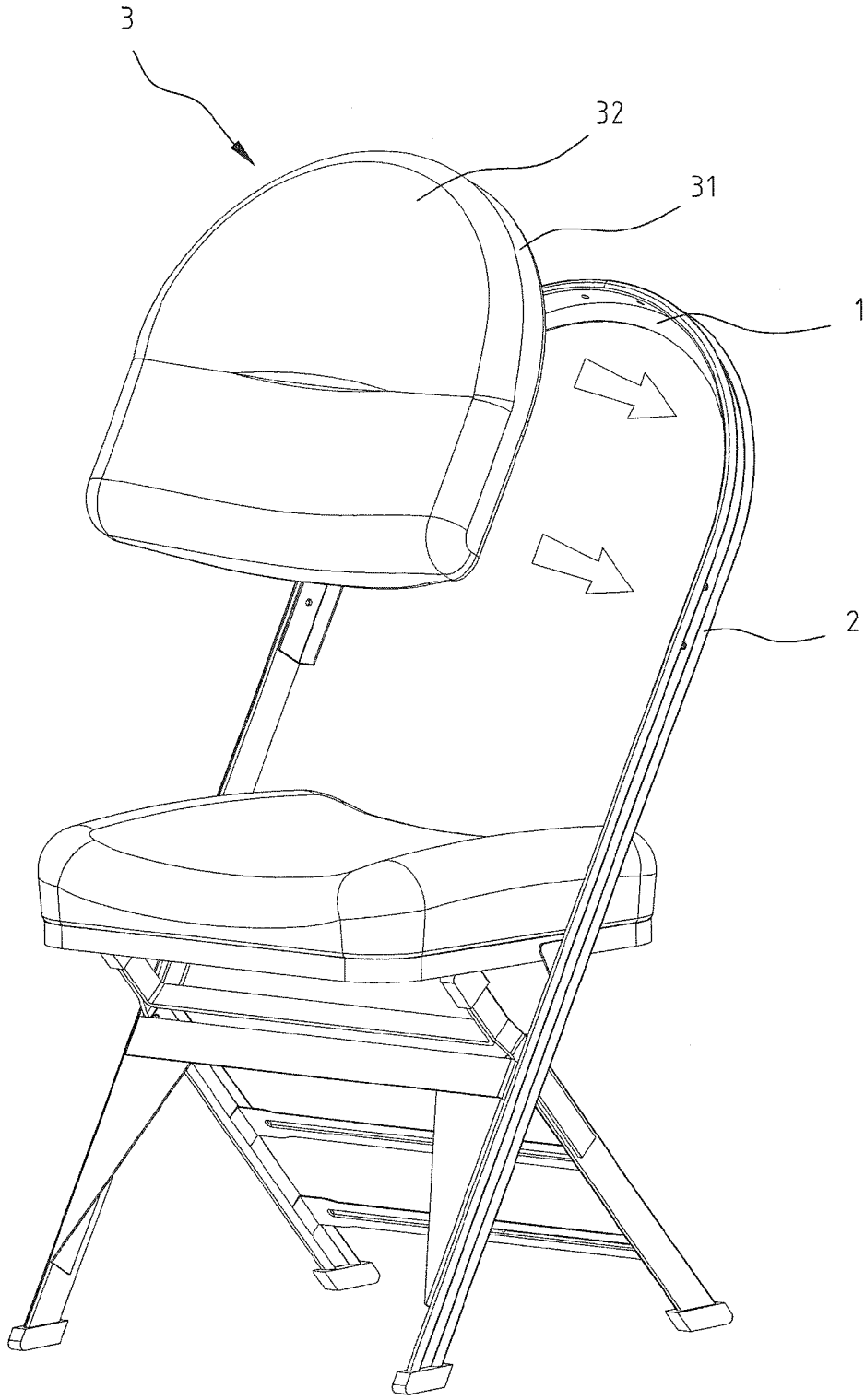
Figure 4:
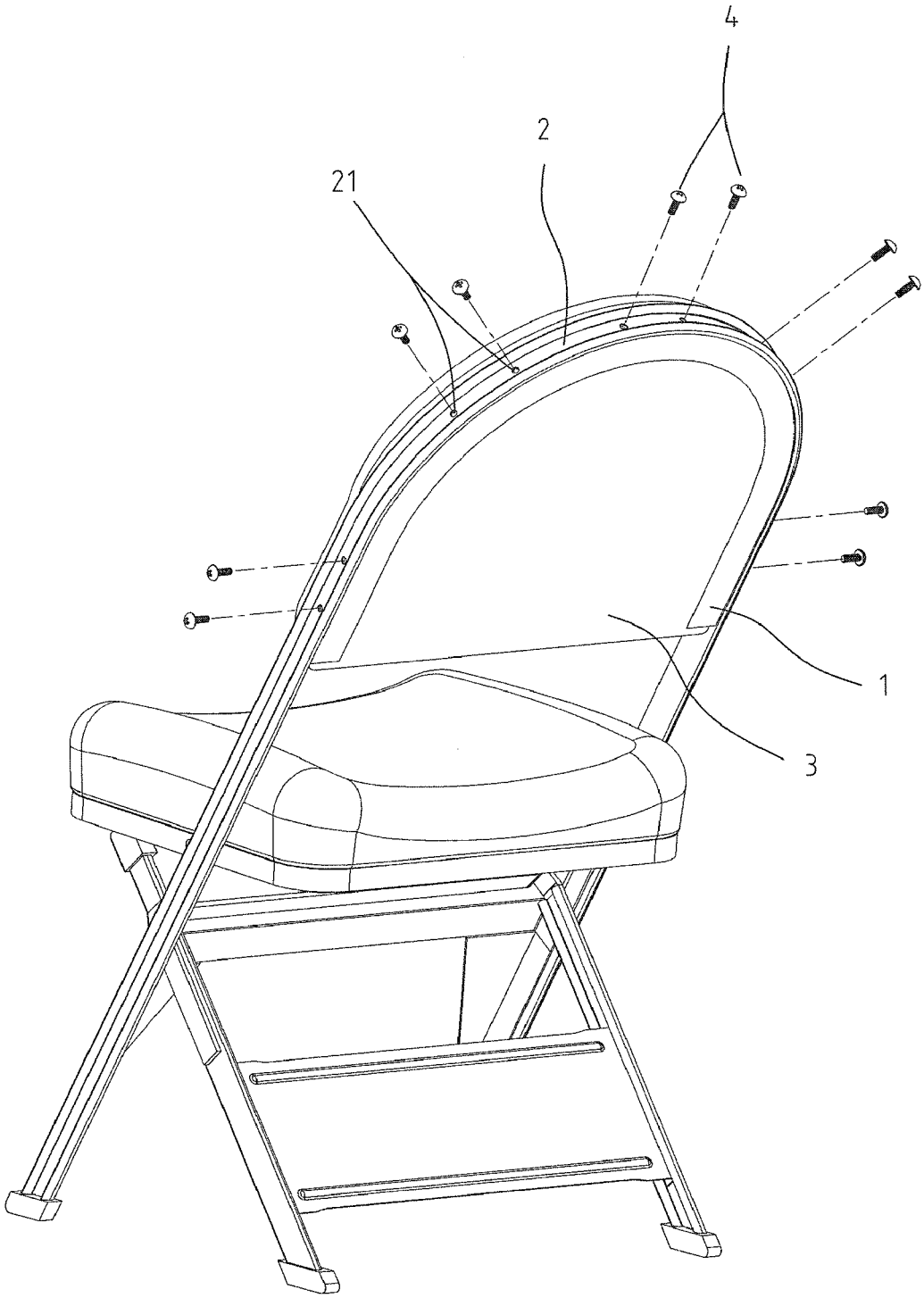
Figure 5:
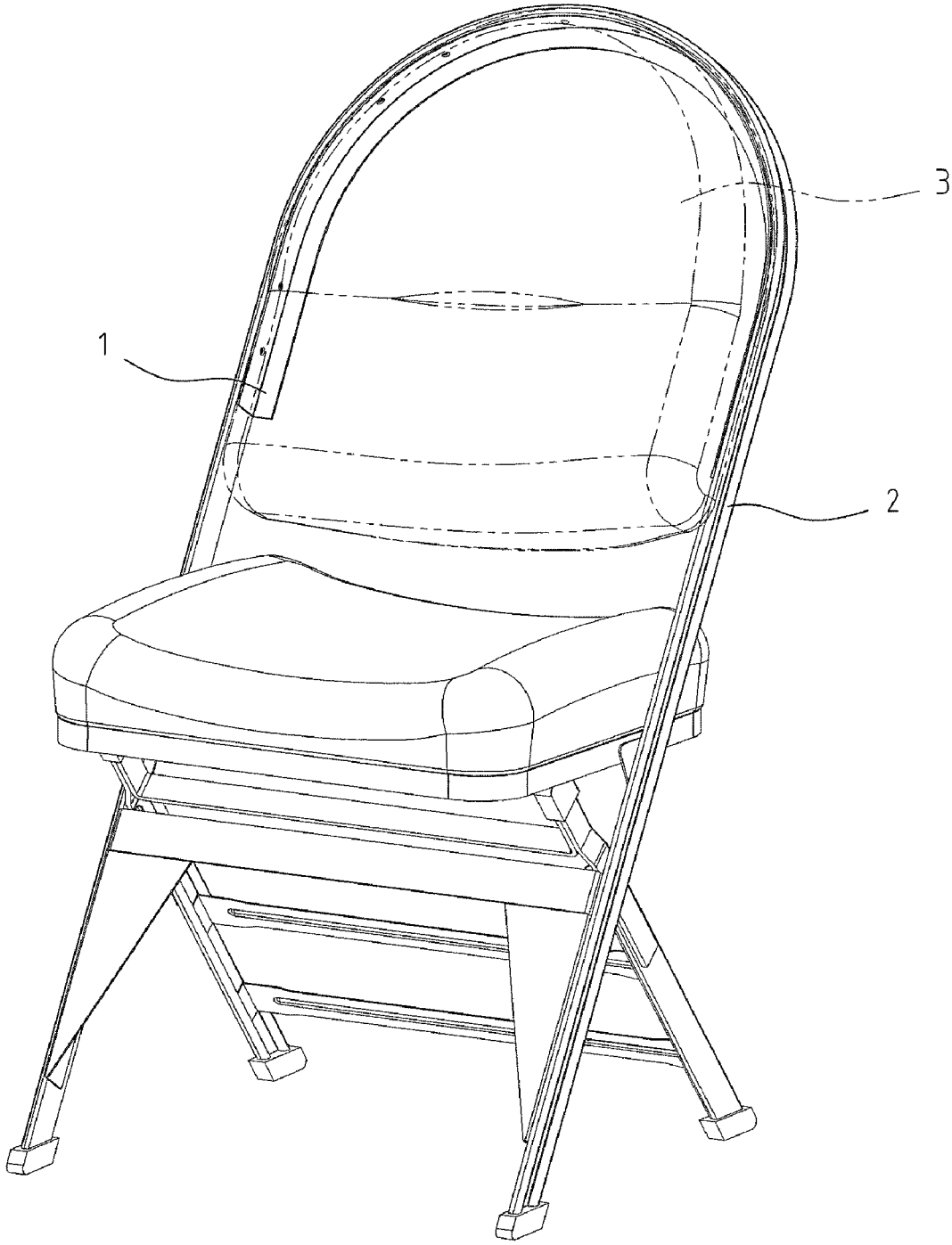

Referring to FIG. 3, the folding super chair further includes a backrest 3. The backrest 3 includes a connection ridge 31 and a cushion 32. The backrest frame 1 has the L-shape cross section and the U-shape contour, and thus provides a space to accommodate the backrest 3. Referring to FIG. 4, the front leg frame 2, the backrest frame 1 and the backrest 3 are provided with a plurality of fixing holes 21 corresponding to each other. A plurality of screws 4 is driven through the fixing holes 21, and therefore the backrest 3, the backrest frame 1 and the front leg frame 2 are connected together. Then, a decoration strip (not shown) is fixed on an outer side of the front leg frame to cover the screws 4 and to enhance the aesthetics of the folding super chair. FIG. 5 is a perspective view showing the folding super chair having the backrest frame 1, the front leg frame 2 and the backrest 3.

Figure 6A:
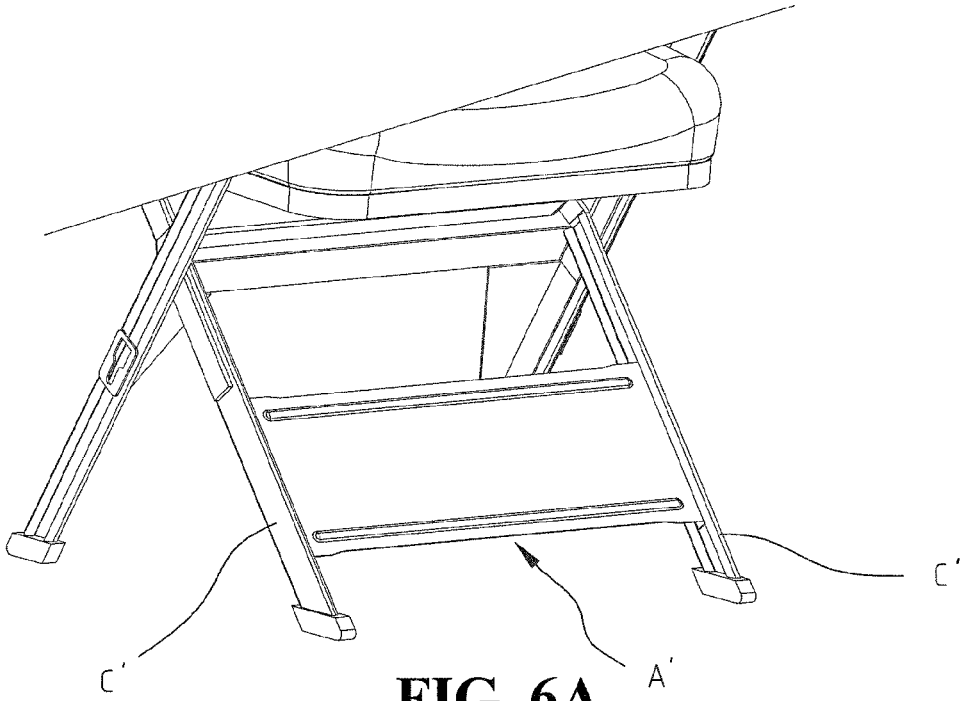
FIG. 6A (PRIOR ART)
FIG. 6A is a detailed view showing a conventional footrest of a folding chair.
Figure 6B:
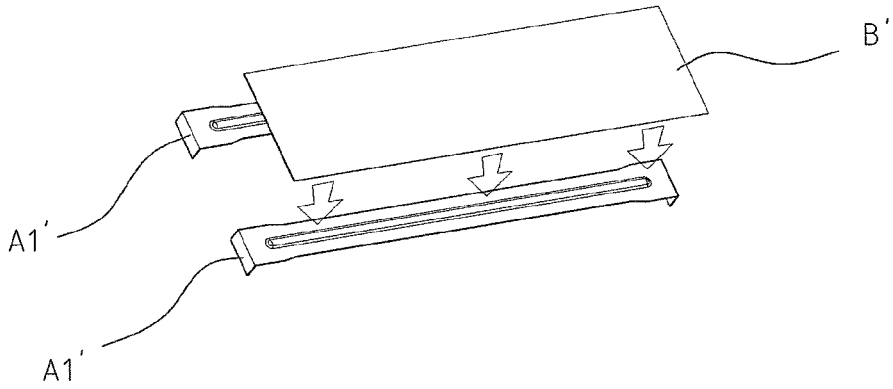
FIG. 6B (PRIOR ART)
FIG. 6B is an exploded view showing the conventional footrest of a folding chair.
Figure 7:
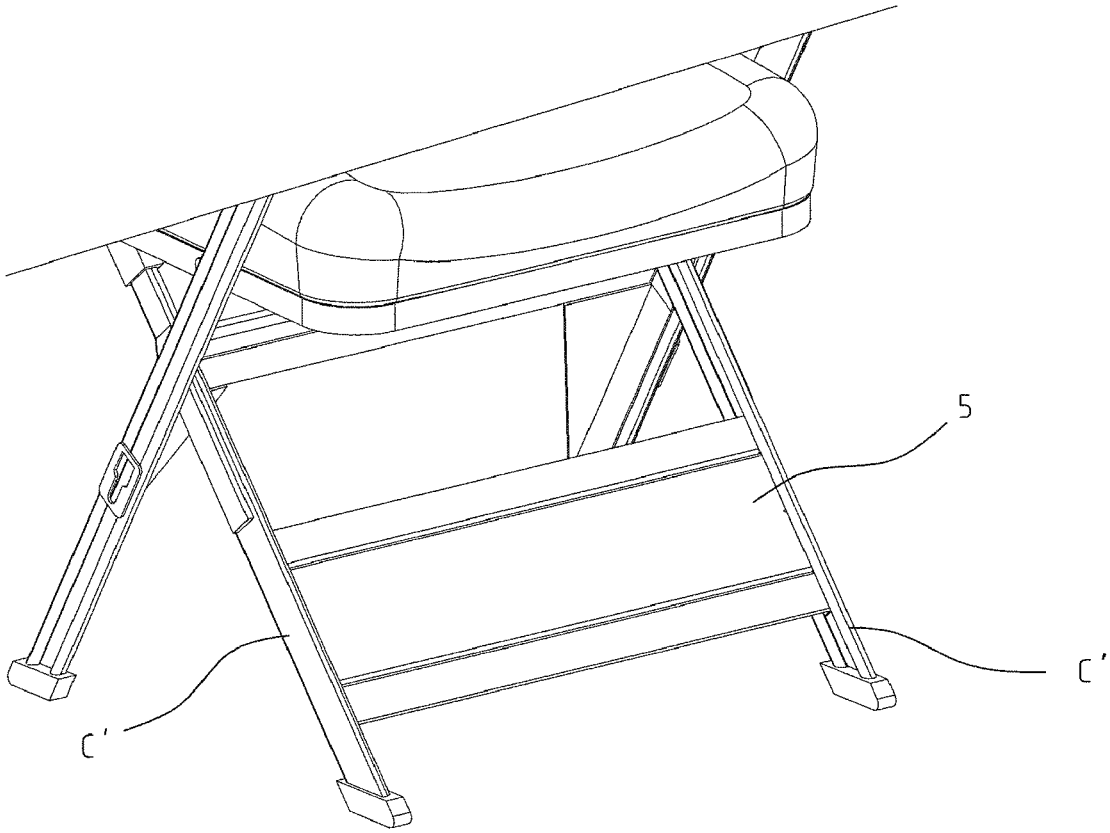
FIG. 7 is a partial view showing a footrest of the folding super chair according to the present invention.

FIG. 6A is a detailed view showing a conventional footrest A' mounted on the rear leg frame C'. FIG. 6B is an exploded view showing the conventional footrest A'. Referring to FIGS. 6A and 6B, the conventional footrest A' includes two horizontal bars A1' having a stamped ridge and a foot plate B'. The horizontal bars A1' are welded to both side of the foot plate B', respectively. Both lateral sides of the horizontal bars A1' are welded to the rear leg frame C'. However, after people repeatedly stamp on the footrest A', the footrest A' is likely to dent. The strength of the conventional footrest A' is not strong enough and the manufacturing process is complicated. Referring to FIG. 7, a footrest 5 according to the present invention is an integrally-formed stamped plate. The footrest 5 is provided with stamped ridges to enhance the strength thereof. Both lateral sides of the footrest 5 respectively include connection strips. The connection strip is perpendicular to the footrest 5 and is welded to the rear leg frame C'. The connection strip distributes the stress caused by foot stamping thereon to the rear leg frame C', thereby enhancing the strength of the footrest 5. Because the footrest 5 is integrally formed, the manufacturing process is simplified and the manufacturing cost is down. Moreover, the footrest 5 provides space to post advertisement.

Figure 8A:
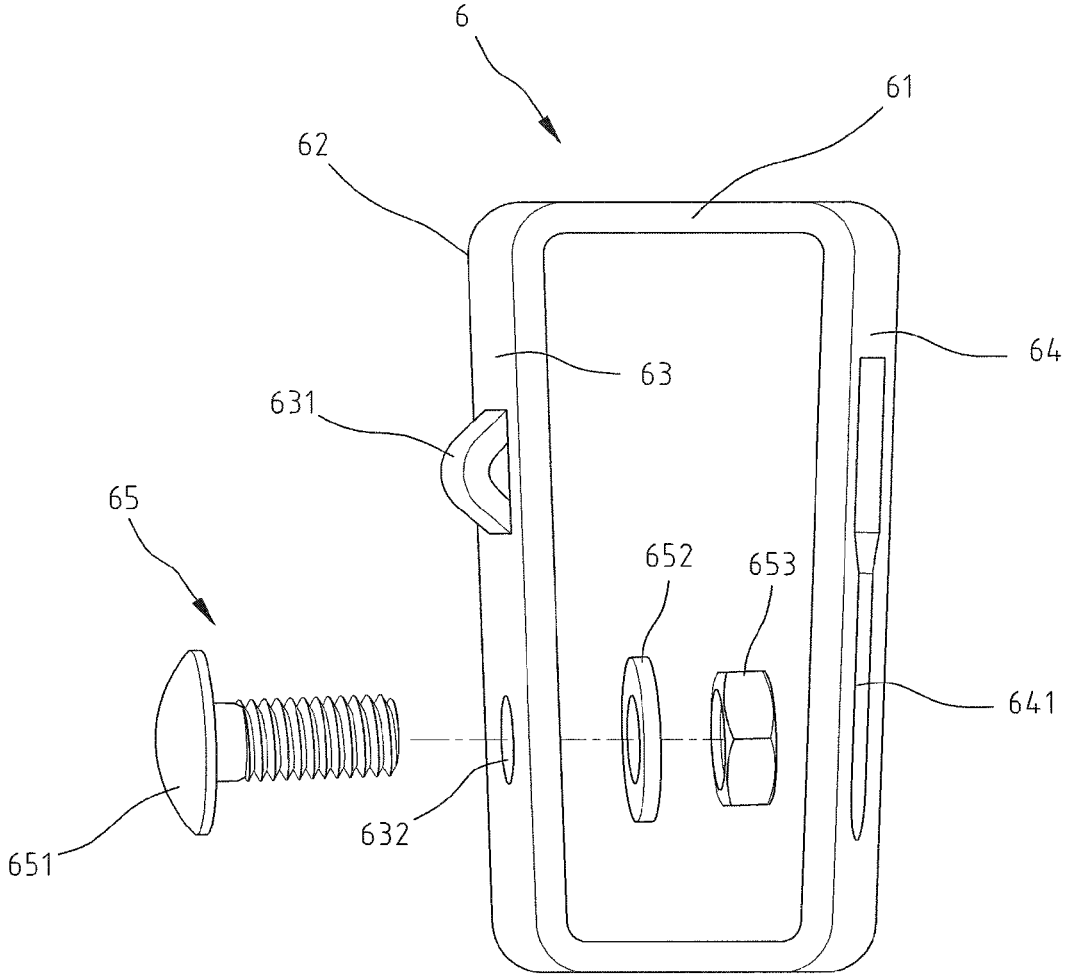
FIG. 8A is an exploded view showing a main member of a ganging device according to the present invention.
Figure 8B:
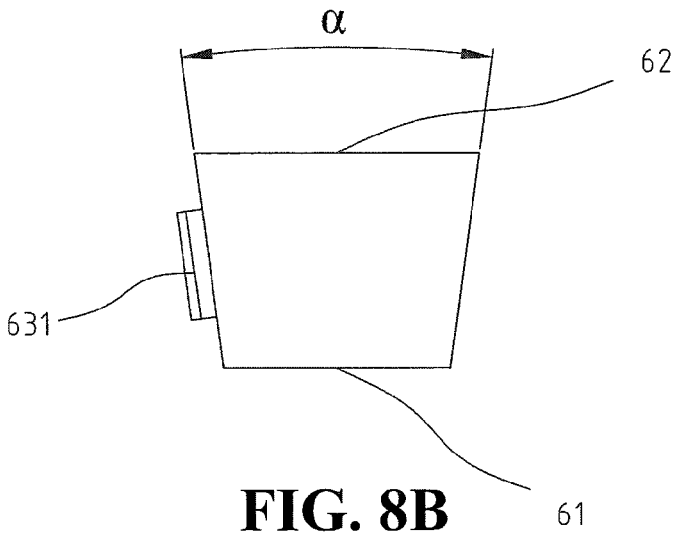
FIG. 8B is a top view showing the main member and an included angle between two side faces.
Figure 9:
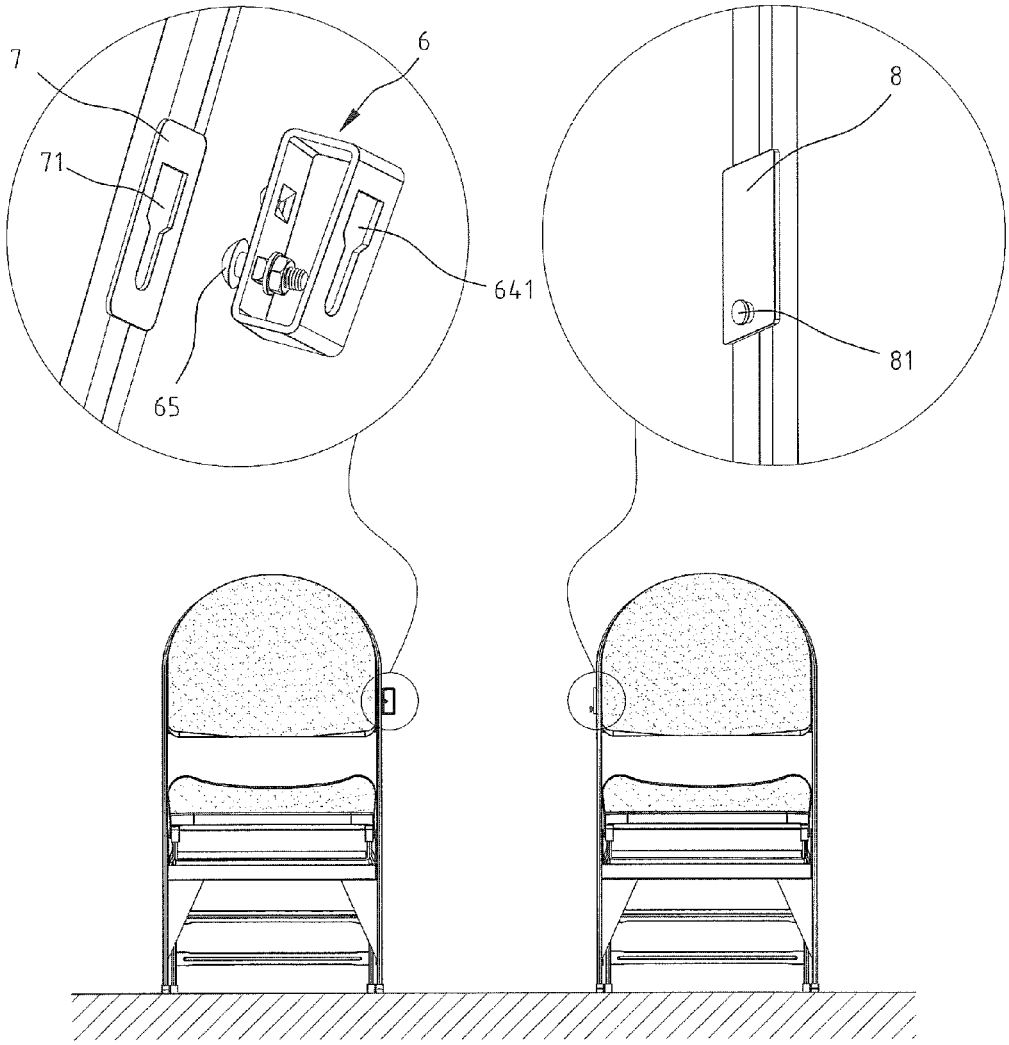
FIG. 9 is a schematic view showing two chairs and the ganging device according to the present invention.
Figure 10:
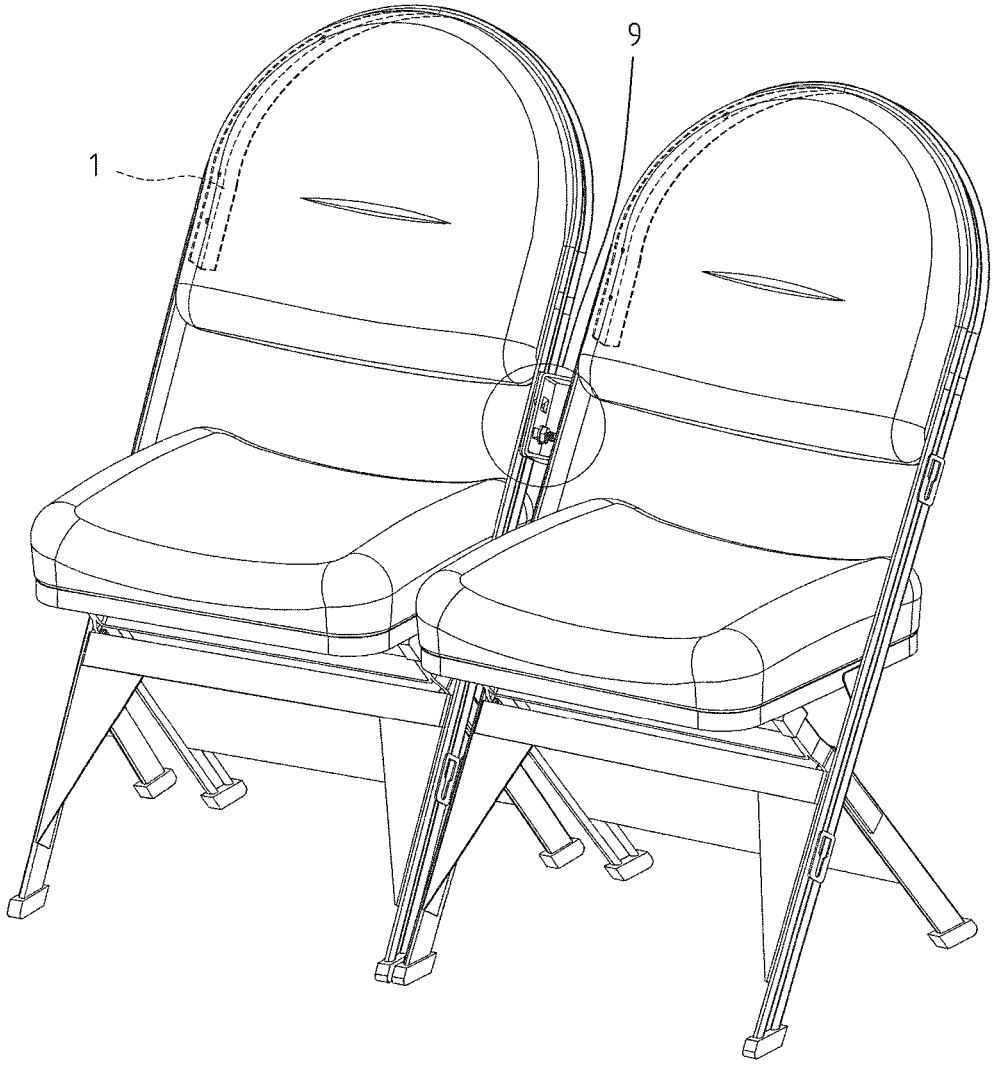
FIG. 10 is a perspective view showing the chairs connected by the ganging device according to the present invention.

Referring to FIGS. 8-10, a ganging device 9 for a folding super chair in accordance with the present invention is mounted between two folding super chairs to enlarge a gap between the connected folding super chairs. The ganging device 9 includes a frame-like main member 6 to increase the gap, and a slot fastener 7 and a knob fastener 8 located at corresponding opposite sides of the front leg frame 2 of the folding super chair.

Referring to FIG. 8A, the main member 6 includes a front face 61, a rear face 62 and two side faces 63 and 64. The rear face 62 is larger than the front face 61. The side faces 63 and 64 are slanted from the rear face 62 to the front face 61. Therefore, the side faces 63 and 64 form an included angle $\alpha$ therebetween as shown in FIG. 8B. The side face 63 includes a fixing device. The fixing device include an engaging protrusion 631, a fixing hole 632 located below the engaging protrusion 631, and a fixing element 65 corresponding to the fixing hole 632. The fixing element 65 includes a screw 651 passing through the fixing hole 632, a washer 652, and a nut 653. The screw 651 includes a screw head and a shank with a helical thread. The side face 64 of the main member 6 includes an inverted-bottle-shaped frame slot 641. The frame slot 641 has a lower neck portion and an upper body portion.

Referring to FIG. 9, the slot fastener 7 is welded on a first side of the front leg frame 2. The slot fastener 7 includes an inverted-bottle-shaped engaging slot 71. The engaging slot 71 has a lower neck portion and an upper body portion. The knob fastener 8 is welded on a second side of the front leg frame at a location corresponding to the slot fastener 7. The knob fastener 8 includes an engaging knob 81 having a knob head and a neck portion. The width of the engaging protrusion 631 is corresponding to that of the body portion of the engaging slot 71. The diameter of the screw head of the screw 651 is smaller than the width of the body portion of the engaging slot 71 but larger than the width of the neck portion of the engaging slot 71. The diameter of the knob head of the engaging knob 81 is smaller than the width of the body portion of the frame slot 641 but larger than the width of the neck portion of the frame slot 641.

When the main member 6 is mounted to the slot fastener 7 on a first chair, the screw head of the screw 651 is inserted into the body portion of the engaging slot 71 and the screw 651 is pushed down to the neck portion of the engaging slot 71, thereby holding the screw head of the screw 651 between the slot fastener 7 and the front leg frame 2. The shank of the screw 651 is inserted into the fixing hole 632 of the main member 6 and the engaging protrusion 631 is fitted into the body portion of the engaging slot 71 of the slot fastener 7. Then, the washer 652 is sleeved on the shank of the screw 651 and the nut 653 is securely screwed down the screw 651. Therefore, the main member 6 is connected with the slot fastener 7, thereby securely mounting the main member 6 onto the front leg frame 2 of the first chair. Because the engaging protrusion 631 is fitted into the body portion of the engaging slot 71, the main member 6 can not be rotated relative to the slot fastener 7. The engaging knob 81 of the knob fastener 8 on a second chair is inserted into the body portion of the frame slot 641 on the main member 6 and the engaging knob 81 is pushed down to the neck portion of the frame slot 641. Thus, the knob fastener 8 on the second chair is engaged with the main member 6 mounted on the first chair. Therefore, the first chair and the second chair are connected by the ganging device 9 according to the present invention as shown in FIG. 10. There is the included angle $\alpha$ between the side faces 63 and 64, and the side faces 63 and 64 contact with the first chair and the second chair respectively. Thus, the first chair and the second chair form the included angle $\alpha$ therebetween.

Figure 11:
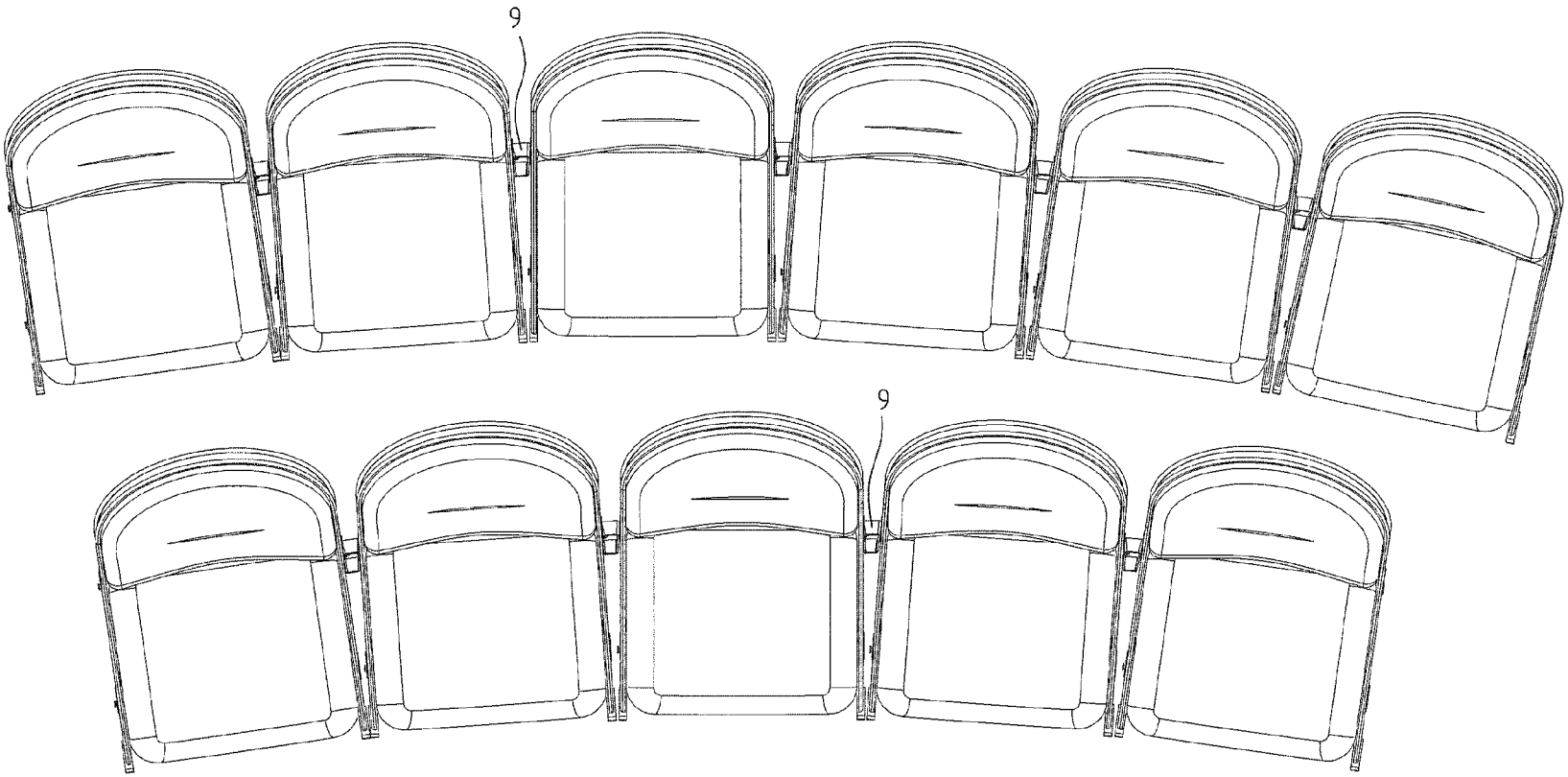
FIG. 11 is a schematic view showing a plurality of the chairs connected by the ganging devices according to the present invention forming two curved rows.
Figure 12:
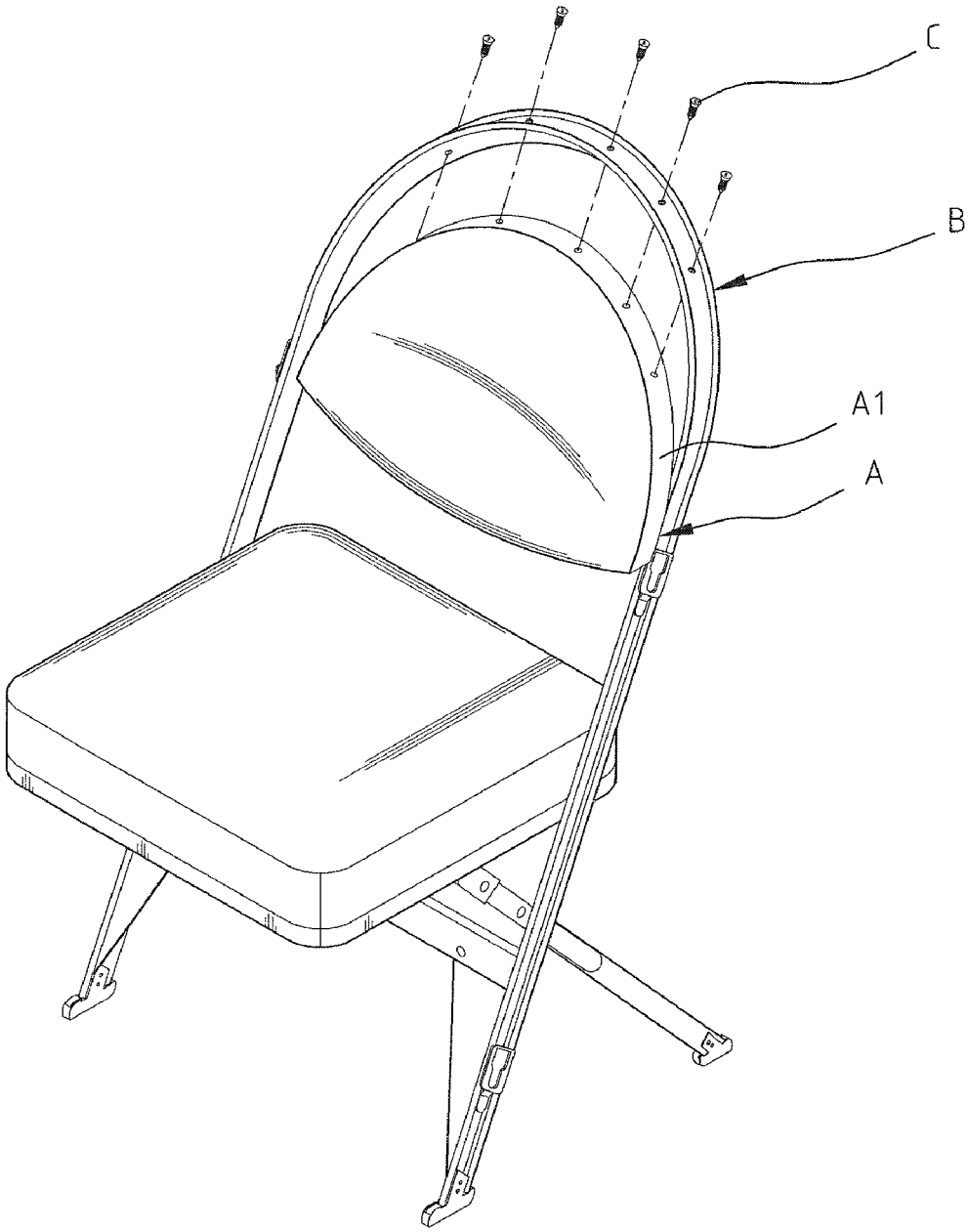
FIG. 12 (PRIOR ART)
FIG. 12 is an exploded view showing a conventional folding chair.
Figure 13:
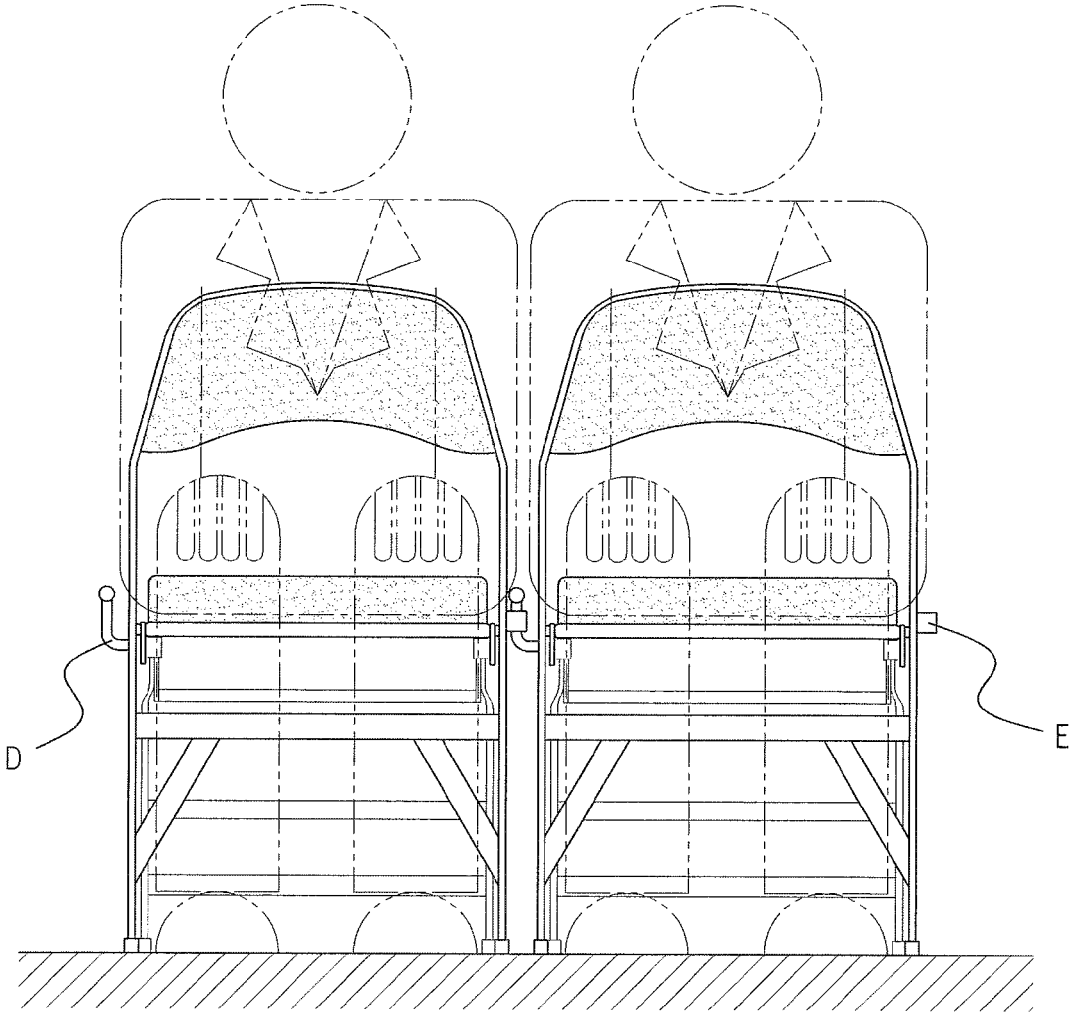
FIG. 13 (PRIOR ART)
FIG. 13 is a schematic view showing two chairs connected by a conventional ganging device.

Referring to FIG. 11, a plurality of the folding super chairs are connected by the ganging devices 9 and lined up in two rows. When two chairs are connected together, there is a spacious gap therebetween. Because the ganging device 9 provides the included angle, front ends of the connected chairs are closer than rear ends of the connected chairs. When a plurality of the chairs is arranged in line, the row of the connected chairs forms an arc. People sitting at both ends of row dot not need to turn their bodies to look at the central front view.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A folding chair, comprising:

a front leg frame having a first side, and a second side opposite to the first side;

a rear leg frame pivotally connected with the front leg frame;

a backrest;

a backrest frame disposed between the backrest and the front leg frame, and having a contour corresponding to that of an upper inner portion of the front leg frame, the backrest resting on the backrest frame;

a plurality of fixing members connecting the front leg frame, the backrest frame and the backrest together; and a ganging device for releasably connecting the folding chair with another chair of a like kind, and comprising a main member, a slot fastener mounted on the first side of the front leg frame, and a knob fastener mounted on the second side of the front leg frame the main member being removable from said chair, and being releasably and selectively connectable to the slot fastener and the knob fastener, and comprising a front face, a rear face, and first and second side faces, the second side face being adapted to receive the knob fastener, and the first side face being adapted to engage the slot fastener, so that when the folding chair and the another chair are connected by the ganging device, the side faces respectively connect with the corresponding slot fastener and the corresponding knob fastener, thereby connecting the folding chair with the another chair; the rear face being larger than the front face and the first and second side faces forming an included angle therebetween so that when a plurality of the folding chairs are connected together by the ganging devices, the folding chairs form a curved row.

2. The folding chair according to claim 1, wherein the backrest frame includes an L-shaped cross section.

3. The folding chair according to claim 1, wherein the first side face that connects with the slot fastener comprises a fixing device and the second side face that connects with knob fastener comprises a frame slot.

4. The folding chair according to claim 3, wherein the fixing device comprises a fixing member movably passing through the first side face and an engaging protrusion located above the fixing member; the frame slot being bottle shaped and having a narrow neck portion.

5. The folding chair according to claim 4, wherein the slot fastener comprises an engaging slot to connect with the fixing device of the first side face, the engaging slot having a narrow neck portion; the knob fastener comprising an engaging knob to connect with the frame slot of the second side face.

6. The folding chair according to claim 3, wherein the slot fastener comprises an engaging slot to connect with the fixing device of the first side face, the engaging slot having a narrow neck portion; the knob fastener comprising an engaging knob to connect with the frame slot of the second side face.

* * * * *